US005495654A

United States Patent [19]

Goodhart et al.

[11] Patent Number: 5,495,654

[45] Date of Patent: Mar. 5, 1996

[54] PREPARING SHEET METAL AND FABRICATING ROOFING SHINGLES

[75] Inventors: Robert R. Goodhart, New Cumberland, W. Va.; Jane M. Brown; William E. Carnahan, both of Toronto, Ohio

[73] Assignee: Weirton Steel Corporation, Weirton, W. Va.

[21] Appl. No.: 225,326

[22] Filed: Apr. 8, 1994

[51] Int. Cl.[6] ..... B23P 17/00

[52] U.S. Cl. ..... 29/527.4; 29/428; 29/460; 52/518; 52/529; 52/530; 52/531

[58] Field of Search ..... 29/527.4, 428, 29/460; 52/518, 529, 530, 531

[56] References Cited

U.S. PATENT DOCUMENTS 3,411,259 11/1968 Anderson et al. ..... 52/531

4,185,436 1/1980 Valee ..... 52/518

*Primary Examiner*—Carl J. Arbes

*Attorney, Agent, or Firm*—Raymond N. Baker; Shanley and Baker

[57] ABSTRACT

Flat-rolled sheet metal is manufactured to preselected gage, mechanical properties and surface finish and is fabricated into unitary sheet metal shingle structures with interlocking folded over sheet metal layers providing for ease of assembly and weatherproofing along each side of a rectangular configuration portion which remains exposed after assembly of shingle structures in side-by-side interlocked relationship in a horizontal direction, and in overlapping partially-covering relationship in a vertical direction. Galvanized mild steel provides lightweight, high-tensile strength, impact-resistant and long-service-life shingle structure. Finish coating enables selection of coloring and thermosetting polymeric coatings facilitate embossing of exposed portions to simulate the appearance of cedar shakes or other types of shingles.

14 Claims, 9 Drawing Sheets

PREPARING SHEET METAL AND FABRICATING ROOFING SHINGLES

The present invention relates to sheet metal shingle roofing, and is concerned with processing flat-rolled sheet metal into light weight sheet metal shingle structures for assembly into durable weatherproof roof covering.

Wood shakes have been highly regarded for roofing notwithstanding that they are subject to deterioration due to moisture, mildew or other infestation. However, due in part to wood shortage problems, wood shake roofs have been subject to increasing costs and diminishing usage.

Composite roofing shingles, having alternating layers of asphalt and tar-treated felt topped with crushed rock, lack tensile strength and can have durability shortcomings. Kiln-fired clay tile, and less expensive concrete tile versions, provide overall strength, but are relatively expensive to install and add excessive weight to a structure.

In a specific embodiment of the present invention, flat-rolled steel substrate is manufactured to preselected gage in continuous-strip form and processed to enhance desired mechanical properties in combination with surface treatment. Such manufacture and surface treatment procedures are selected to produce lightweight, strong, impact-resistant and long-service-life roofing material which, in combination with selected fabrication steps as taught, provide ease of assembly and waterproof, wind-resistant, and fireproof characteristics for roof covering.

Other advantages and contributions are set forth in describing specific embodiments of the invention shown in the accompanying drawings, in which.

Figure 1:
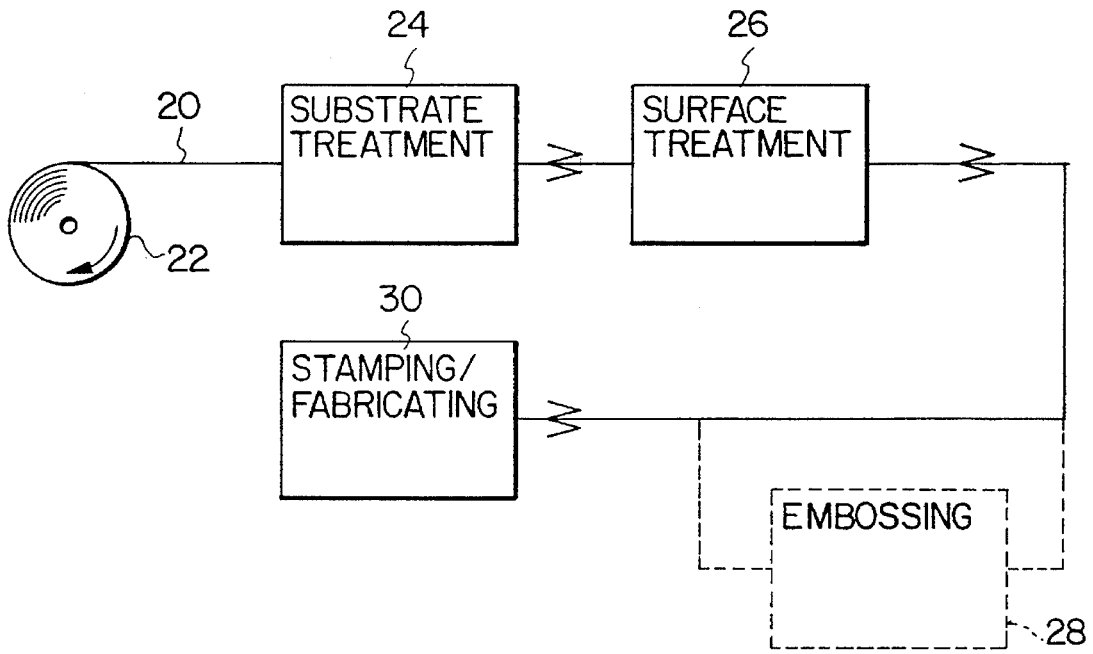
FIG. 1 is a block diagram for describing a combination of sheet metal processing steps of the invention.

In the embodiment of FIG. 1, flat-rolled sheet metal substrate 20, in continuous-strip form from roll 22, is directed for sheet metal processing at substrate treatment stage 24 and surface treatment at stage 26. Surface embossing can be carried out intermediate those stages, or at stage 28, or later. Surface embossing of metal in sheet form is carried out in a pattern which takes into account later cutting of unitary blanks for fabrication and assembly of shingle structures. Such patterned embossing aspect will be better understood from later description. The sheet metal of FIG. 1 is directed for stamping and fabricating at station 30.

Combinations of sheet metal processing steps are preselected to produce desired mechanical properties of tensile strength, hardness and ductility in the substrate which are relied on for fabrication of shingle structures, ease of roofing assembly, strength of an assembled roof, roofing performance and durability.

Surface-processing steps are selected in relation to sheet metal properties and surface characteristics. Selection of relative electrochemical properties of metals is relied on in selecting and applying protective metallic coatings to specific substrate metals for purposes of extending desired appearance features for the useful life span of shingle structures made achievable by other contributions of the present roofing technology.

Flat-rolled sheet metals, along with manufacture and surface treatment combinations, are disclosed in more detail after describing shingle structure fabrication with references to FIGS. 3–9 and assembly in relation to FIGS. 10–15. Embossing procedures are selectively made available as part of continuous-strip processing (as shown in FIG. 1) and/or later as part of fabrication. The viewable portion after assembly of the roof covering of the invention is referred to as a "tab" portion, or a "course" portion, of the shingle structure. Metal substrate, coated or uncoated, is generally referred to as sheet metal during description of fabrication steps and in referring to portions of the fabricated shingle structures used in assembly as taught by the invention.

Figure 2:
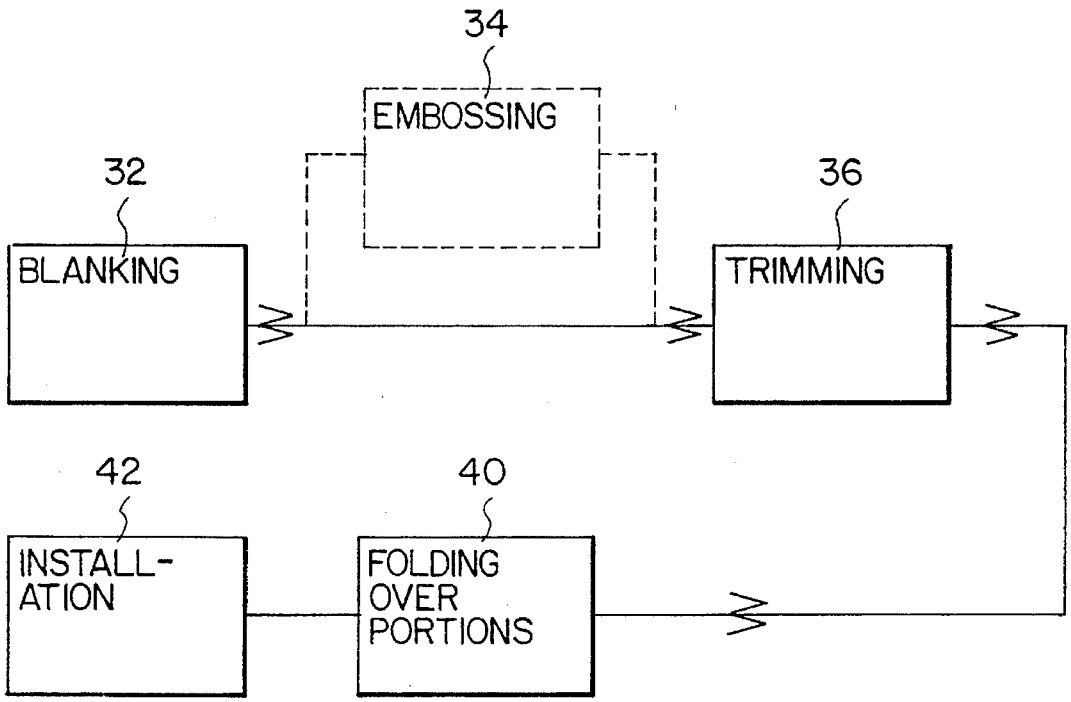
FIG. 2 is a block diagram for describing a specific embodiment fore producing a rectangular configuration unitary blank in accordance with the invention.

In the embodiment of FIG. 2, the processed flat-rolled metal, in sheet or continuous-strip form, is cut into unitary blanks of prescribed-configuration at station 32. Patterned embossing, limited in area and depth of contouring, can be carried out so as not to interfere with assembly of the shingle structure to be fabricated. Such embossing can be carried out prior to or after surface treatment as indicated at 26 in FIG. 1, or prior to trimming of FIG. 2. When embossing involves in-depth surface contouring of an exposed area, it is preferably carried out at stage 34, taking into account the subsequent fabricating steps.

Portions of a unitary blank are cut away at trimming stage 36 of FIG. 2. Such trimming is preferably carried out prior to folding over portions at station 40. After the trimming and folding-over fabrication steps, as described below, the shingle structures are then ready for use, or for packaging and shipping for installation as represented by stage 42.

Figure 3:
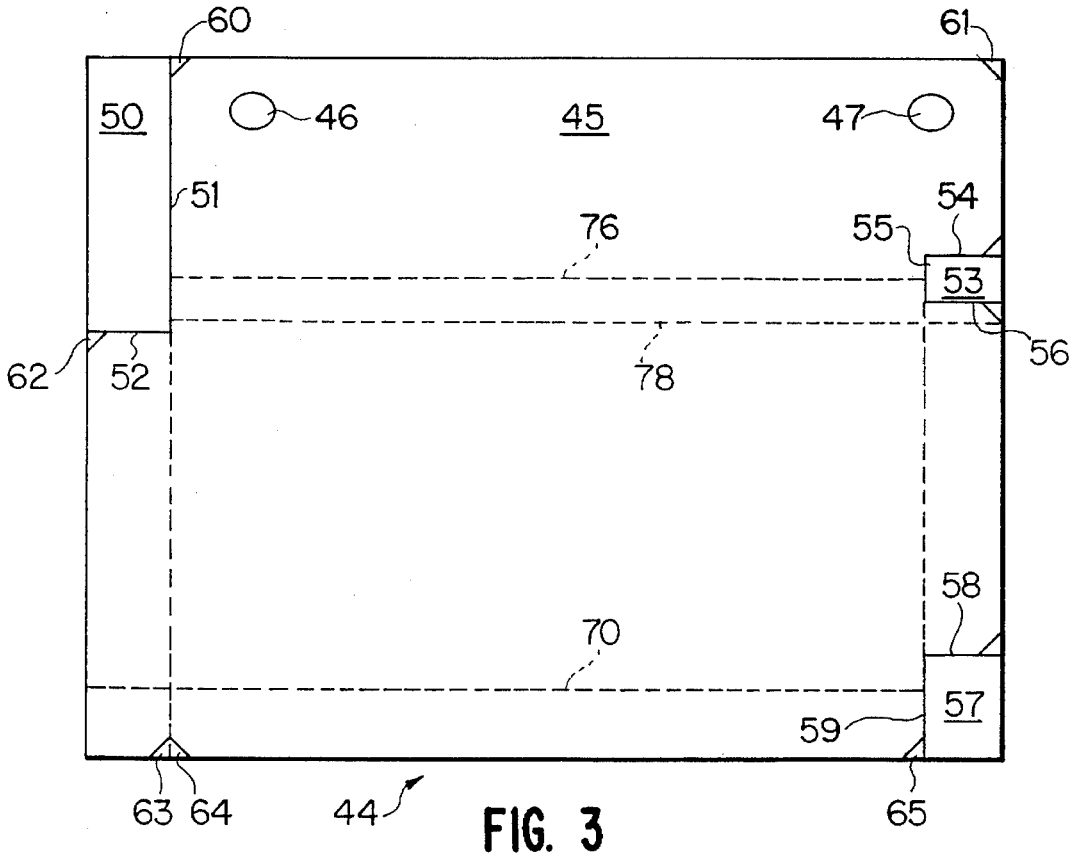
FIG. 3 is a plan view of a rectangular configuration unitary blank for describing portions to be cut away, and portions to be folded over onto the remainder of the blank, for fabrication of a roofing shingle structure in accordance with the invention.

In FIG. 3, solid lines within a rectangular configuration perimeter of unitary blank 44 delineate cutaway sections and interrupted (broken) lines indicate fold lines which at least partially delineate fold-over sheet metal portions. Substantially rectangular-configuration shingle structures, fabricated in accordance with the invention, present an interlocking capability during and after assembly, at each side of an exposed four-sided portion which is exposed after assembly. Such four-sided viewable portion can be a single "tab". Or, in another embodiment of a unitary shingle structure, the four sides can surround an exposed portion in which the external appearance presents more than a single exposed "tab". In a specific embodiment, the appearance of a pair of horizontally-directed courses each with tabs in side-by-side relationship is presented, and the courses are arranged, one above the other, in staggered relationship.

The stamping and fabricating steps of cutting away and folding over sheet metal layer portions of blank 44 are illustrated in sequence in FIGS. 3–9. The results of those sequential steps define a unitary shingle structure with an axis extending in a generally horizontal direction in which shingle structures are laid in side-by-side relationship to form a shingle "course" during assembly of roof covering; and a "vertical" axis extending in a direction in which shingle structures are laid in an upward direction from an eave toward a ridge of a roof section.

Referring to FIG. 3, a shingle structure to be formed from blank 44 is subdivided so as to establish an upper "covered" portion 45 which includes at least a pair of apertures 46 and 47, and a lower "exposed" portion which forms part of a "course" as viewed after assembly.

At the upper left corner of blank 44, lateral edge section 50 is cut away along solid lines 51, 52. At the opposite lateral side of blank 44, section 53 is cut away along solid lines 54, 55, 56; and, at the lower edge of that lateral side, section 57 is cut away along solid lines 58, 59.

After removal of cutaway sections 50, 53 and 57, remaining right-angled corners may be rounded or cut to provide beveled corners as shown, for example, by lines 60, 61 of the "cover" portion 45. Apertures 46, 47 for fastening shingles to roofing support structure are defined by cutting or stamping from cover portion 45. Other beveled corners can be provided about the unitary blank as shown; for example, at corners 62, 63, 64 and 65 of the lower portion of the blank.

Figure 4:
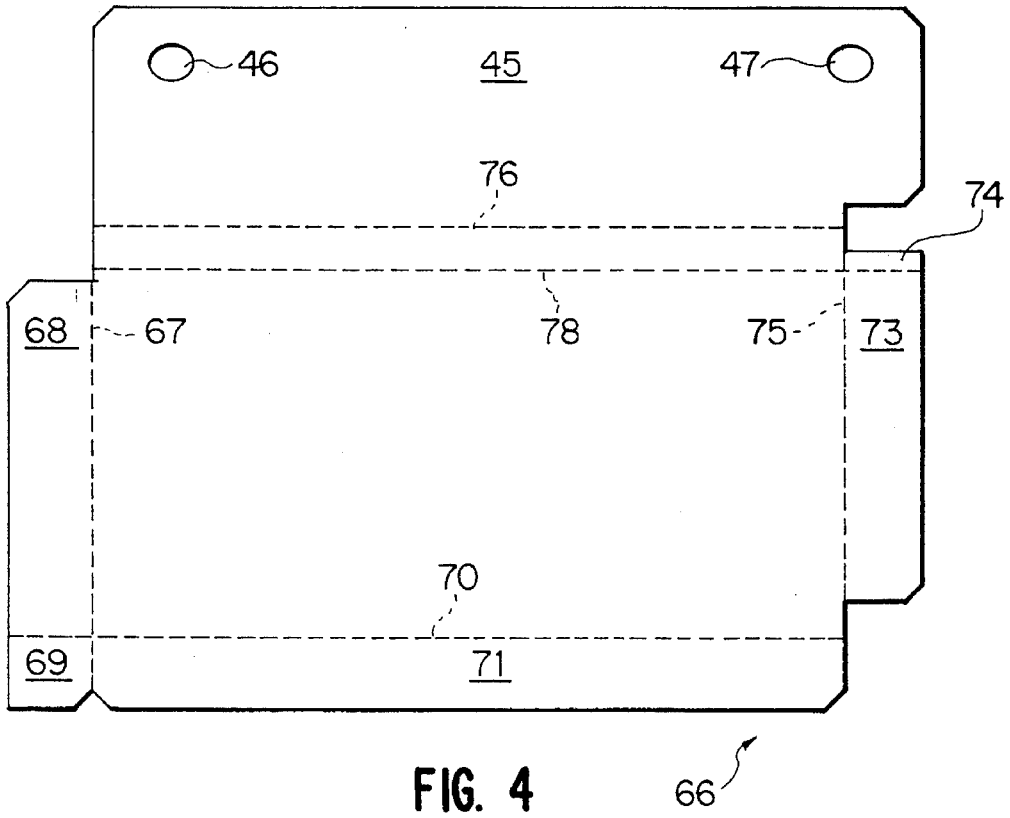
FIG. 4 is a top plan view of the unitary blank with cutaway portions (as designated in FIG. 3) removed and portions to be folded over shown in interrupted lines.

The cutaway configuration 66 for fabricating a shingle structure is shown in top plan view in FIG. 4. The beveled corners around the perimeter facilitate handling, fabricating and later assembly of fabricated shingle structures without sacrificing watertightness at such corner portions, or at horizontally-extending or vertically-extending perimeters of such shingle structures. The beveled-corner perimeter enhances the above purposes, whether used with a unitary shingle structure fabricated to have a single exposed tab, or a unitary shingle structure having more than a single tab viewable after assembly.

Sheet metal fold-over locations are designated by interrupted lines in FIG. 4. A layer of sheet metal to be folded over is presented along each lateral side of the exposed portion of a unitary shingle structure. Sheet metal is folded over along a lateral side so as to enable coupling with a fold-over layer of sheet metal of an adjacent shingle structure arranged in a side-by-side horizontal direction during assembly. Four-sided coupling means about a rectangular-configuration exposed portion is an important contribution of the invention.

Interlocking of the unitary shingle structures also provides for incremental expansion and contraction, both horizontally and vertically, so that assembled roofing of the invention can readily assimilate varying climatic conditions experienced during differing seasons, or during differing times of day, at different locations of a variegated roof.

At the left lateral side of the embodiment of FIG. 4, fold line 67 helps to define an elongated vertically-extending lateral side section 68 which is to be folded over onto the interior surface of the shingle structure being fabricated from the cutaway blank configuration 66. Lateral side sections, such as 68 and portion 69, are folded-over before folding over horizontally-oriented sheet metal layers for the two remaining sides of a rectangular configuration exposed portion of the shingle structure.

Figure 5:
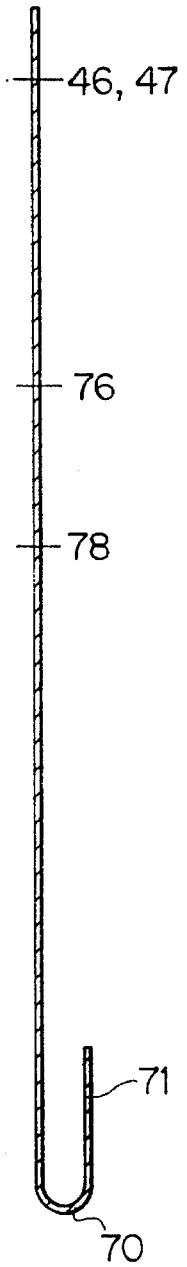
FIGS. 5, 6 and 7 are vertical cross-sectional views for describing fold-over steps in forming slot means used in vertical-direction assembly of roofing shingle structures as disclosed by the invention.
Figure 6:
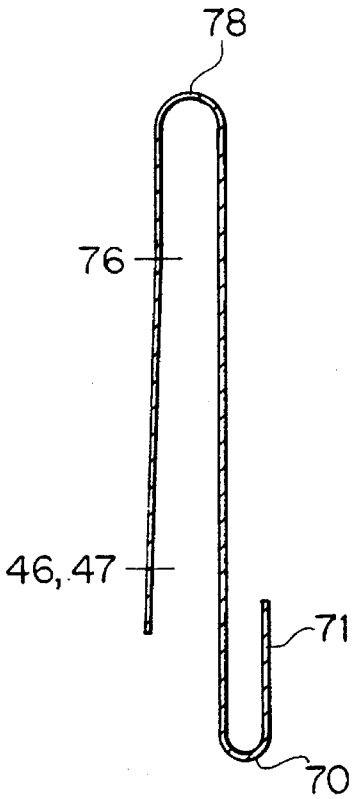
Figure 7:
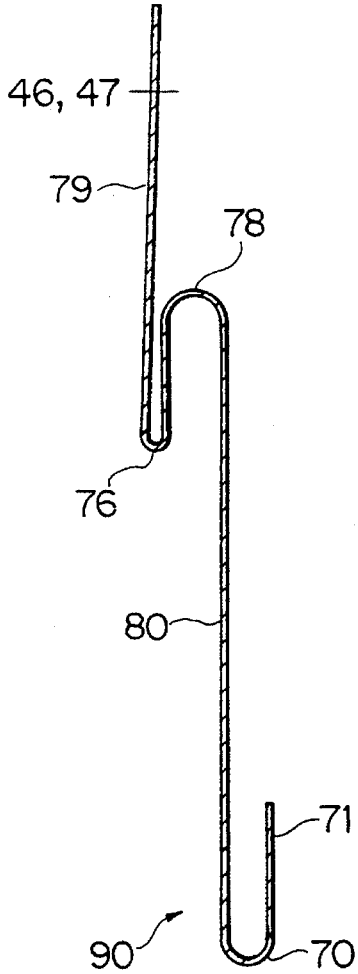

Horizontally-extending fold line 70 (FIGS. 3, 4) helps to define elongated sheet metal layer 71 which is folded over onto the interior surface (as shown in FIGS. 5–7). However, the folding over of horizontally-directed layer 71 differs from the fold-over of lateral side section 68 and portion 69 along line 67.

Lateral side section 68, and portion 69, present a single sheet metal layer to be folded over. Section 68 is folded over in a manner which defines a vertically-directed narrow-opening slot for receiving a single fold-over layer of sheet metal of a contiguous side-by-side shingle structure. Such folded over lateral sheet metal layers interfit relatively tightly, effectively interlocking the shingle structures, along the full lateral sides of their respective exposed portions.

Horizontally-extending fold-over layer 71 is, however, folded over onto the interior of the shingle structure in an upward direction at 70 so as to present a recessed rounded-shape, which presents an enlarged-opening slot for interfitting with centrally-located horizontally-directed multiple-layer downwardly-directed fold means of sheet metal with similarly rounded-shape presenting open slot means. Such centrally-located multiple sheet metal layer folds result from the fabricating steps shown schematically in FIGS. 5–7.

Section 73, and portion 74, along the right lateral side of cutaway blank configuration 66 of FIG. 4, are folded over (along fold line 75) onto that surface of blank 66 which will be the exterior surface of the shingle structure being fabricated. Such lateral side section 73 is folded over in a manner similar to opposite lateral side section 68; that is, is spaced from the overlaid surface so as to facilitate receiving, in close-fitting relationship, a single thickness of flat-rolled sheet metal to a horizontally-adjacent shingle structure.

Folding over of lateral side single layer sections 68, 73 is preferably carried out before folding of the horizontally-directed layer (such as 71 along fold line 70). It should be specifically noted that portion 69, at the lower end of lateral side section 68, will be folded over to become a part of horizontally-directed fold 71. That lower portion 69 is pinched tightly onto the interior surface and adds to the watertightness at that lateral side of assembled shingle structures.

Also, the lateral sections are folded over before executing the folds along horizontally-oriented lines 76, 78 which form the centrally-located horizontally-directed fold means of a shingle structure. The steps in forming such centrally-located horizontally-directed fold means of the shingle structure are described with reference to the vertical direction cross-sectional views of FIGS. 5–7.

In a specific embodiment, an upper portion 74 (of lateral side section 73) is folded over and pinched tightly near line 78 of FIG. 4, against the exterior surface of the shingle structure being fabricated. At that lateral location, such closely pinched portion 74 becomes part of a centrally-located horizontally-directed fold means which adds to the watertightness at that lateral side of assembled shingle structures.

The centrally-located horizontally-extending fold lines 76, 78 of FIGS. 3, 4 and subsequent figures, orient multiple sheet metal layers to form horizontally-extending rounded-shape open slot means of the shingle structure. One embodiment of the sequence of steps is described in relation to the cross-sectional views of FIGS. 5–7.

The cross-sectional view of FIG. 5 shows the vertical location of fold lines 76, 78, before forming the centrally-located horizontally-directed fold means of the shingle structure. The lower edge fold-over of layer 71 onto the interior surface of the unitary blank is carried out by folding over along fold line 70 as seen in cross-section in FIG. 5.

FIG. 6 shows the step of downwardly-directed folding over of an upper sheet metal portion along fold line 78. An enlarged-opening slot is formed with a recessed rounded-shape located at 78. The elongated enlarged-opening slot (with closed end at 78) is oriented with its open end facing in a downward direction. That enlarged-opening slot enables reception of rounded-shape multiple sheet metal layer fold means as part of side-by-side horizontally-directed assembly, or of the open slot formed by layer 71, which is located along the lower edge of a next adjacent shingle structure in a vertical direction during roofing assembly.

The lower curved edge of sheet metal at location 76 is moved upwardly to form upper cover portion 79, such that cover portion 79 is in substantially parallel relationship to the plane of lower course portion 80, as shown in FIG. 7.

The sheet metal layers defining the recessed rounded-shape at 76 of FIG. 7 fit within a lower edge slot corresponding to that defined by metal layer 71 during vertical direction assembly, as better seen in a later view.

In a preferred embodiment, rounded-edge portions at 76 and 78 (FIG. 7) are formed with preselected narrowing cross-sectional configuration along the direction of the horizontal axis as described in more detail in relation to later assembly FIGS. 8–14. Such preselected configuration along the horizontally-directed slot means facilitates nesting of coacting parts during assembly, enhances reception and retention of vertically-contiguous shingle structures, and contributes to the weatherproofing and watertightness of the assembled shingle structures of the invention.

Figure 8:
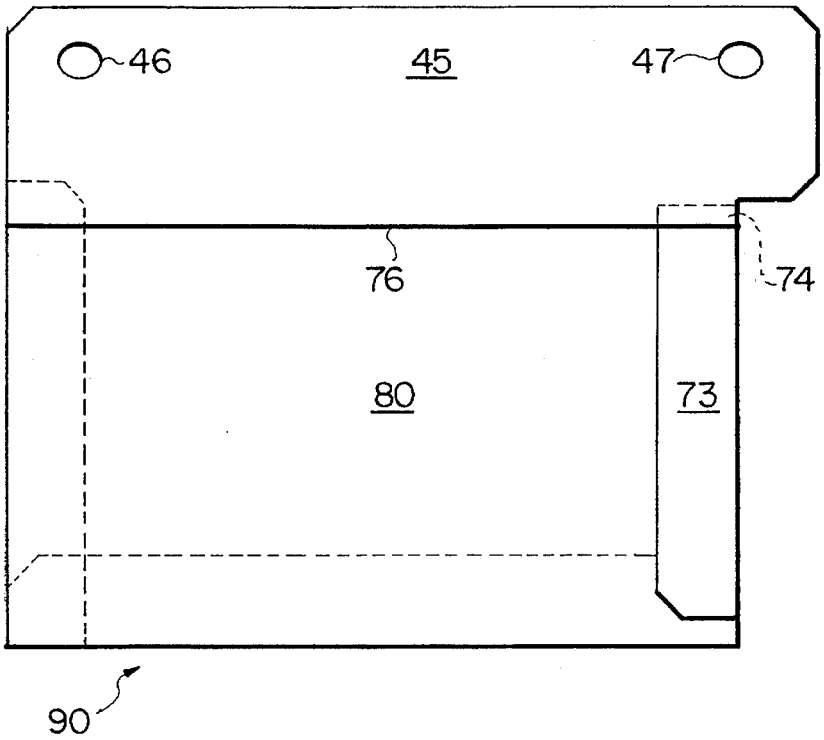
FIG. 8 is a top plan view presenting the exterior surface of a roofing shingle structure of the invention after the cutting away steps of FIG. 3 and the folding over steps described in relation to FIGS. 5–7.
Figure 10:
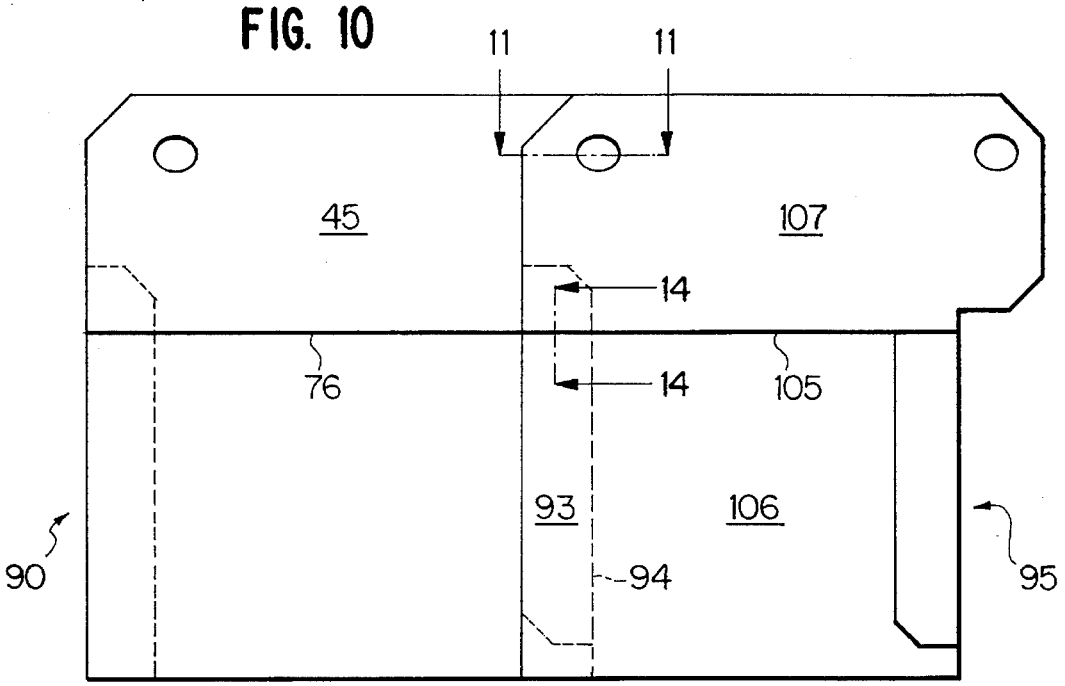
FIG. 10 is a top plan view of a pair of roofing shingle structures for describing assembly in side-by-side horizontally-directed adjacent relationship along a roofing course as taught by the invention.
Figure 14:
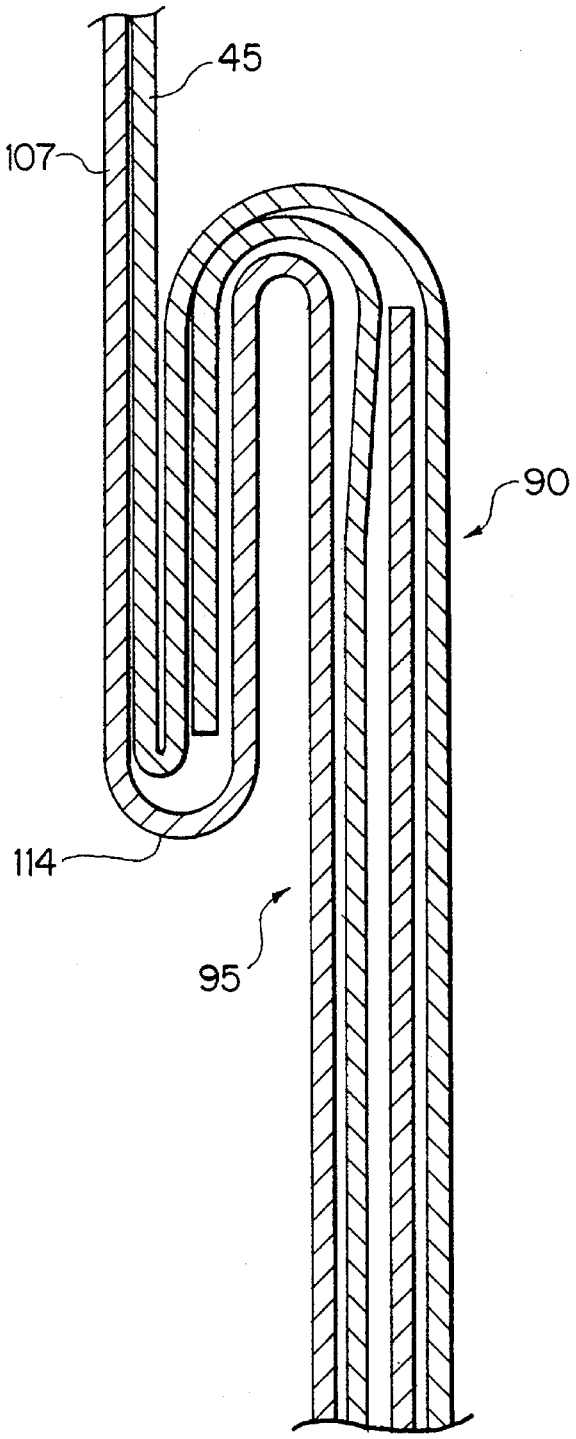
FIG. 14 is a cross-sectional view, taken along the line 14—14 of FIG. 10, for describing side-by-side interlocking assembly of shingle structures in accordance with the invention.

In the specific embodiment being described, lateral section 73 of FIG. 4 is folded over onto the exterior surface of shingle structure 90, as shown by the plan view of FIG. 8, with portion 74 to be located at a distal end of a centrally-located slot and with 78 at its closed end, as described in more detail in relation to FIGS. 10 and 14.

Figure 9:
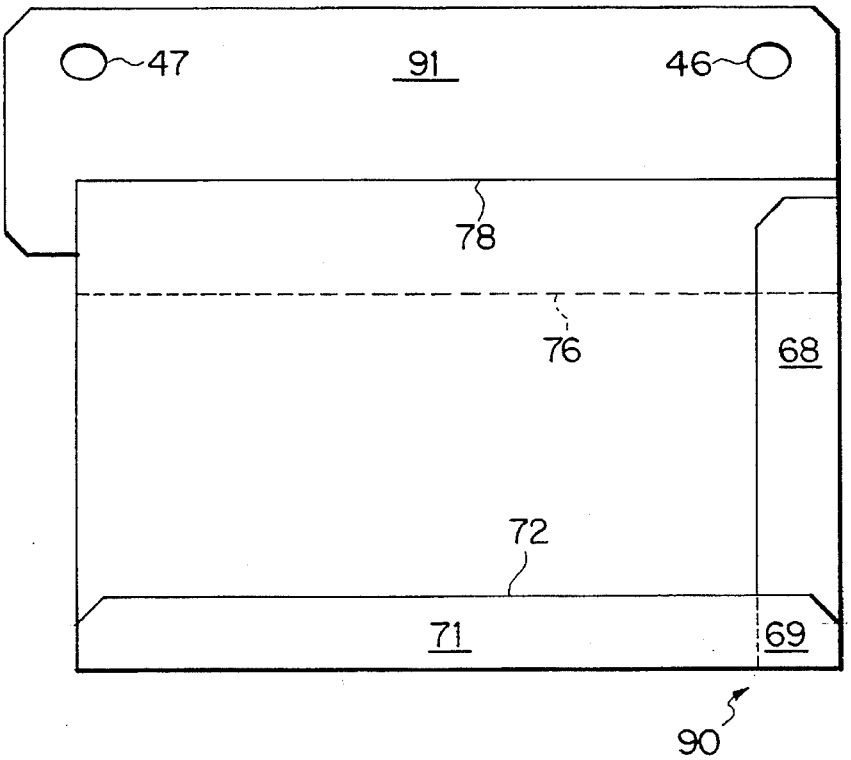
FIG. 9 is a bottom plan view presenting the interior surface of the roofing shingle structure of FIG. 8.

FIG. 9 is an interior surface plan view of shingle structure 90 showing folded over lateral side section 68 and lower portion 69 as folded over, with section 71 at the horizontally-extending lower edge. In FIG. 9, the horizontally-extending location 78 separates interior surface portion 91 from the lower course portion of the shingle structure. In assembly from left to right, a lateral side section corresponding to 68 of a next adjacent shingle structure fits within the lateral side slot defined by fold over section 73 (FIG. 8).

Referring to FIGS. 8, 9 and later views, a specific embodiment of the present invention adapted, for example, to roofing for residential houses, including houses with relatively small dormer windows, can be fabricated with the following dimensions:

EXAMPLE I

| | Dimension |
|---|---|
| width of 80 (FIG. 8) | 7.99 inches |
| width of 45 (FIG. 8) | 8.62 inches |
| height of 45 (FIG. 8) | 2.28 inches |
| diameter of apertures 46, 47 (FIG. 8) | .256 inches |
| width of 73 (FIG. 8) | .610 inches |
| height of 80 (FIG. 9) | 4.21 inches |
| height of 71 (FIG. 9) | .787 inches |
| width of 68 (FIG. 9) | .906 inches |
| distance between 76, 78 (FIG. 4) | .650 inches |

The above tabulated dimensions set forth dimensions for a specific single-tab shingle structure embodiment of the invention. Larger shingle structure dimensions useful for larger roof-covering expanses would utilize proportionally larger dimensions.

In addition to a unitary shingle structure with a single exposed tab portion, an enlarged panel-like unitary blank can be fabricated to present multiple-exposed tab portions which give the impression of two or more individual shingle courses along a horizontal direction, as well as two or more rows in a vertical direction. The same four-sided interlocking assembly means fabricating steps, as described above, are utilized for such an enlarged multiple-tab structure.

A preferred size of unitary shingle structures is determined in part by convenience in handling such structures during movement to a roof structure and during installation. The principles of assembly for weatherproof characteristics are the same whether for a single tab exposed unitary structure portion, or for a unitary structure providing a staggered appearance, or for a shingle structure which includes a pair of horizontally-directed courses one above the other with staggered "tabs" delineated by embossing, as described later herein.

FIG. 10 presents side-by-side horizontally-directed assembly of shingle structures along a roofing course with a pair of shingle structures which are identical to the shingle structure described in relation to FIGS. 8 and 9. During such assembly, a lateral fold-over section 93 (corresponding to 68 as described in relation to FIG. 9) indicated by dashed line 94, is folded over onto the underside ("interior") of the shingle structure 95. Folded over section 93 fits into an exterior-surface lateral-side fold-over section 73 of shingle 90 as described in relation to FIG. 8. (Such exterior-surface fold-over section 73 was described in relation to FIG. 8.)

Right-to-left assembly can be facilitated by reversing the interior and exterior fold-over of the lateral side sections (that is, section 68 being folded over onto the interior surface, and section 73 being folded over onto the exterior surface).

Figure 11:
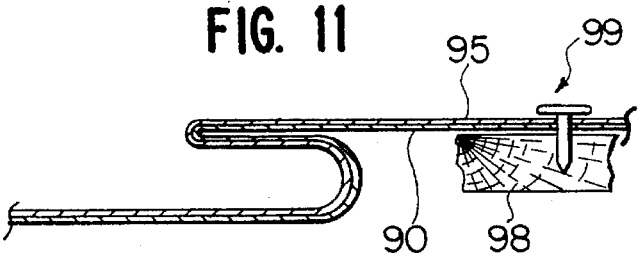
FIG. 11 is a partial cross-sectional view taken along line 11—11 of FIG. 10 for describing use of a single schematically-shown fastening means at one location to secure two shingle structures to subsurface roofing support structure.

A coaction between side-by-side shingle structures and a single roofing fastener are shown in FIGS. 10, 11. An aperture is located near the lateral side of the cover portion of each fabricated shingle structure so as to provide coincidence with an aperture in the next side-by-side adjacent shingle structure. The coincidence of oppositely-located, lateral-side apertures enables use of a single fastener, at each lateral side, for securing two horizontally-adjacent shingles to subsurface roofing support structure, such as 98 shown in FIG. 11, during installation.

The apertures are of a cross-sectional size and shape in relation to the cross-sectional size and shape of the stem portion of fastener 99 so as to facilitate side-by-side and vertical alignment and, also, to facilitate minor adjustment of relative locations of shingle structures vertically and horizontally during assembly of roof covering.

Preferably, a screw-type fastener, such as a wood screw, is used as the single fastener with a wood subsurface support, in view of the long useful life span provided by the shingle structures of the invention. The diameter of the respective paired apertures is less than that of the head of fastener 99, but greater than the diameter of the stem portion of such fastener.

Figure 12:
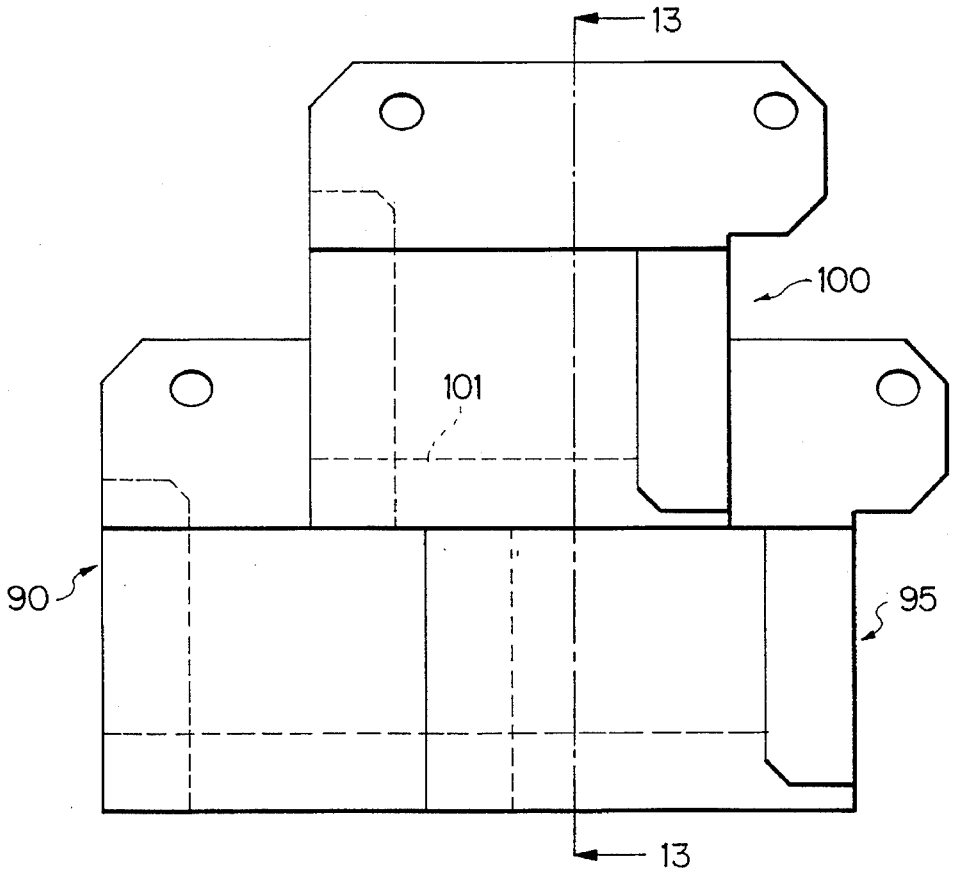
FIG. 12 is a top plan view for describing vertical direction assembly by adding a shingle structure identical to that shown in FIG. 8 to the assembled pair of FIG. 10.

FIG. 12 is a plan view of horizontally-directed assembly, from left-to-right, and upward assembly in a vertical direction toward a ridge of a roofing expanse. Shingle structure 100 (FIGS. 12, 13), has fold-over metal layer 101 along its lower, horizontally-directed edge. Metal layer 101 interfits along the mid-section of a centrally-located horizontally-elongated downwardly-opening slot defined by shingle structure 95; that mid-section location is shown in vertical cross-section in FIG. 13. The intercoupling at distal ends of this centrally-located horizontally-directed slot means is shown in FIG. 14.

Figure 13:
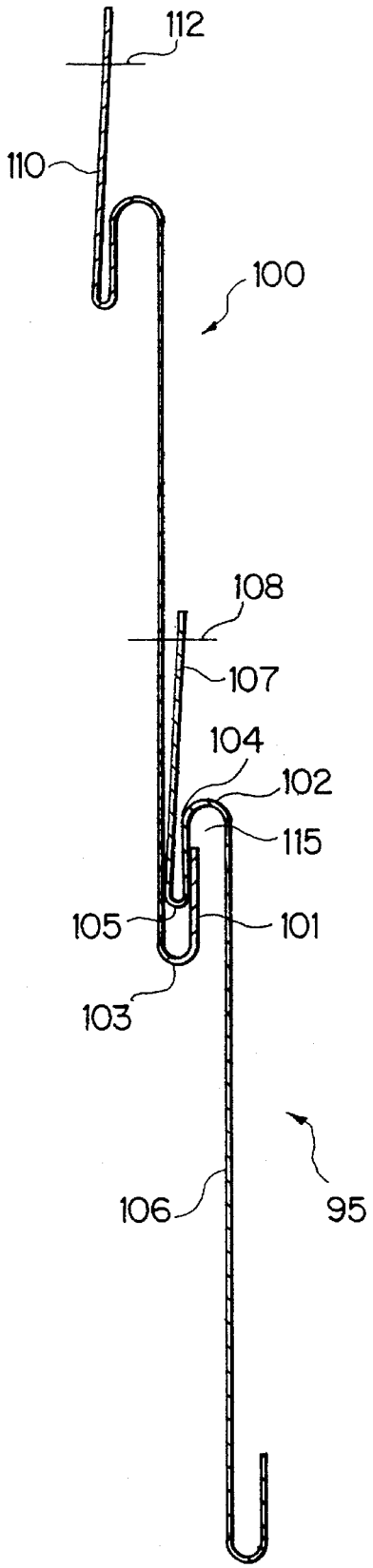
FIG. 13 is a cross-sectional view for describing vertical direction assembly of shingle structures taken along line 13—13 of FIG. 12.

In FIG. 13 shingle structure 100 is assembled in the vertical direction, with its lower edge underside fold-over sheet metal layer 101 interfitting within the elongated downwardly-opening slot having an interior rounded shape, designated 102 at its closed end. Fold-over layer 101 forms the lower-edge elongated slot having its rounded-shape at its closed end 103. Fold-over sheet metal layer 104 of shingle structure 95 extends downwardly from rounded-shape 102. For purposes of vertical-direction assembly, structure 95 at location (105) defines a rounded-shape which fits within receiving fold-over layer 101 during assembly of the next vertically adjacent shingle structure such as 100.

Shingle structure 95 presents exposed external surface 106 (FIG. 13) which extends from, and forms part of, the multiple sheet metal layers of the centrally-located horizontally-directed folds of such shingle structure. Cover portion 107 extends upwardly, in folded-over relationship to metal layer 104. Vertical location for aperture centerlines, in cover portion 107 of shingle structure 95, is indicated by interrupted line 108. The aperture centerline locations for cover portion 110 of shingle structure 100 are indicated by interrupted line 112.

Horizontally-directed, side-by-side assembly of shingle structures (90, 95) is shown in plan view in FIG. 10.

FIG. 14 presents a cross-sectional partial view, taken along the line 14—14 in FIG. 10, depicting the intercoupling at distal ends of the centrally-located horizontally-directed slot means of shingle structures as assembled in side-by-side relationship along a course.

Referencing FIGS. 10 and 14, the opening of centrally-located horizontally-directed slot of shingle structure 90 (extending along fold line 76 of shingle structure 90) gradually increases in approaching its right-lateral side distal end. Such an increasing opening dimension is provided in order to facilitate horizontally-directed assembly and interfitting of a corresponding left lateral side distal end of centrally-located multi-layer fold means of shingle structure 95.

Such interlocking of respective distal ends of centrally-located horizontally-directed multiple sheet metal-layer fold means of shingle structure 90 and 95 is depicted in cross-section in FIG. 14. Shingle structure 95 is overlapping and presents slot means 114. Each shingle structure, in cross-section, presents multiple sheet metal layers because of the lateral side folded over metal which extends into the centrally-located folds and slot means.

The multiple sheet metal layers at the distal end of the horizontally-directed fold means of shingle structure 90 nest tightly within the distal end slot means defined by shingle structure 95, when shingle structure 95 is pulled to the right during assembly interlocking such distal ends and the lateral side folds of each shingle structure.

The interfitting shown in FIG. 14 emphasizes an important novel contribution of the invention which provides weatherproof interlocking at and above distal ends of horizontally-extending slot means of each pair of assembled shingle structures and such watertight interlocking extends downwardly along each interlocked lateral side.

The downwardly-opening slot designated 115 in FIG. 13 has an enlarged opening for receiving the multiple folded over sheet metal layers which interfit at the horizontally-directed distal ends of side-by-side shingle structures.

In vertical cross-section, overlapping distal ends of horizontally-directed fold-over layers interlock, as described above in relation to FIGS. 10 and 14, along with lateral edge sections. Multi-layer sheet metal, which includes sheet metal layer 104 and a portion of 107 (of FIG. 13), fit into the lower edge upwardly-opening slot formed by sheet metal layer 101, and that slot is sufficient to receive the overlapping distal ends of FIG. 14.

The opening dimension of downwardly-opening slot 115 gradually increases in the left to right assembly in approaching the right side distal end of slot 115 as formed by multi-layer folds of shingle structure 95 to facilitate the multiple sheet metal layers at such distal ends, as described earlier.

In FIG. 13, shingle structure 100 is moved upwardly to complete the interfitting between structures 95 and 100. That type of interfitting (at 103, 115) between vertically-adjacent shingle structures (such as 95, 100) continues between shingle structure 100 and the next vertically-adjacent shingle structure. The co-action between shingle structures (along such horizontally-extending slots) resists wind damage; and, wind force, in an upward direction as would be required to separate shingle structures, tends to tighten down the next above shingle structure which, in turn, helps to secure the lower shingle structure.

Figure 15:
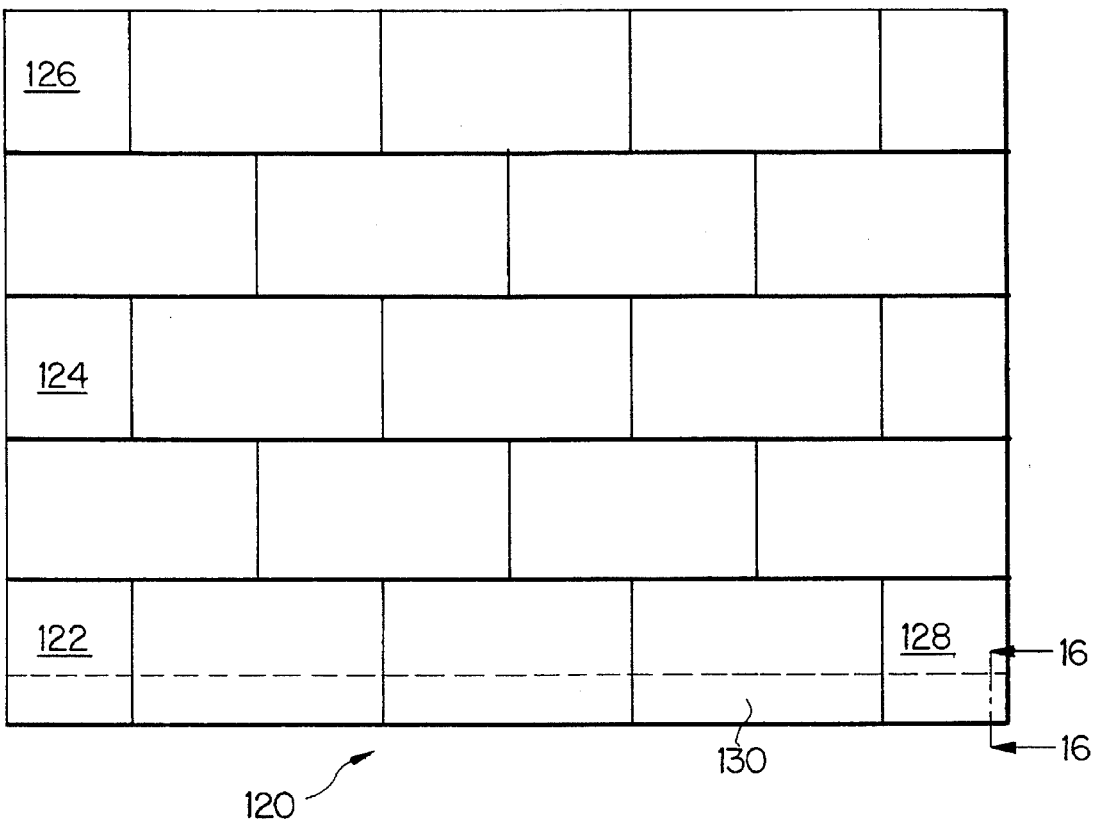
FIG. 15 is a top plan view of a rectangularly-shaped roofing expanse assembled from shingle structures as fabricated in accordance with FIGS. 3–9 in which half-shingle configurations are used in alternate courses at the lateral sides in extending from an eave toward a ridge of the roofing expanse.

FIG. 15 depicts a rectangular-shaped roof expanse 120 assembled from a plurality of shingle structures installed side-by-side in a horizontal relationship, as shown and described in relation to FIGS. 10, 14, and vertically, as shown and described in relation to FIGS. 12, 13. During assembly of multiple courses, as shown, every other course in the vertical direction is preferably started with a half-shingle exposed portion, such as 122, 124, 126, to provide staggered vertical junctures of individual exposed portions along a horizontal course.

Half-shingle configurations are also employed at the opposite end, for example at 128, of such alternate courses in a rectangular configuration roof as shown in FIG. 15. A staggered effect can also be accomplished by fabricating perimeter starting shingles for alternate courses with exposed portions equal to one and a half-tab lengths. The interfitting at distal ends of the horizontally-extending slots means, and along lateral side edges, remains the same whether fabricated as a half-tab unit, a one and a half-tab unit, or with a plurality of exposed tab portions in a unitary structure.

Such exposed tab portions can be part of a unitary multiple-tab structure with individual tab-portions embossed along the horizontal direction, and can be embossed vertically, if more than one horizontally-directed course is included in a unitary structure. The interfitting along the four sides of the multiple-tab exposed portion for assembly is carried out as described previously.

Figure 16:
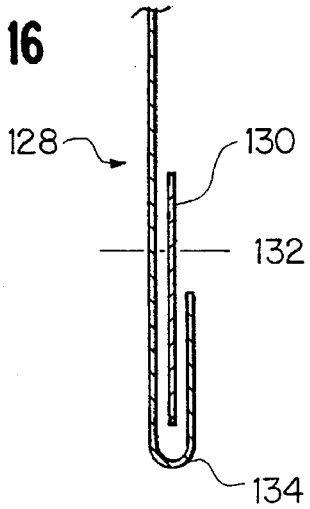
FIG. 16 is a vertical cross-sectional view of a lower edge portion of the assembled roofing, taken along lines 16—16 of FIG. 15, for describing initiation of assembly along an eave portion of the roofing expanse.

Vertical assembly of shingle structures is preferably started along an eave of a roofing expanse 120 as shown in FIG. 15. For improved alignment purposes, an extended-length starter strip 130 is positioned, as shown by the broken line of FIG. 15, in order to form a straight-edge eave. As shown in the cross-sectional view of FIG. 16, such straight-edge border strip 130 is established along the eave (preferably in parallel relation to a ridge portion of the roof expanse) by fasteners located as indicated by centerline 132 of FIG. 16. The lower edge underside fold-over sheet metal layer 134 of shingle structure 128 fits over and is held by metal border strip 130 for start of assembly of roofing expanse 120. Other shingle structures along the horizontal direction of such course are similarly started and interfitted as described in relation to FIGS. 10, 14; and, shingle structures are assembled vertically as described in relation to FIGS. 12–13.

Sheet metal selection, as taught by the invention, is based on such factors as fold-over fabrication, impact resistance (to protect against damage due to hail), and tensile strength (to support the weight of roofing personnel during or after assembly). Also, resistance to abrasion and long-life surface protection, as well as aesthetically-pleasing and durable coloring, are provided for commercial purposes by surface treatments and coating.

Ductility of the sheet metal selected is provided by taking into account fabrication requirements as well as the depth and extent of surface embossing to be provided while maintaining desired tensile strength.

A preferred sheet metal substrate for economy, impact-resistance, tensile strength, embossing and fabrication capabilities and for facilitating durable, long-service-life surface protection, comprises flat-rolled low carbon steel, generally referred to as mild steel. Such flat-rolled steel can be work-hardened by cold-rolling to increase tensile strength and impact hardness while maintaining (or controlling) stress relief, desired stamping, fabricating and embossing capabilities. Controlled heat treatment is carried out prior to finish coating to provide ductility for contoured embossing.

A wide variety of surface pigmentation is made practicable by use of protective-finish coatings, preferably thermosetting polymeric films applied in solvent, particulate, or solid form. Such films, as applied, are not harmed by subsequent fabrication as taught herein.

Flat-rolled shingle structure sheet metals include aluminum-coated steel, copper, copper-plated steel, electro-galvanized steel, galvanizing-alloy hot-dip coated steel, terne-coated steel, tin mill product (electrolytictin, chrome, chromate-plated steel), selected magnesium-aluminum alloys, and stainless steels.

A chemical-type surface treatment of planar surfaces is used preferably during continuous strip processing such that both interior and exterior shingle structure surfaces are protected. Chemical treatments include a passivating treatment to inhibit oxidation; as well as a surfactant treatment to enhance adhesion of color pigmentation in the form of paint or thermosetting plastic films. Chemical surfactant treatments are selected from complex oxides, conversion coatings and mixed metal oxides which enhance application and adherence of selected paints and thermosetting polymeric finish coatings for protection, colorizing, or fabrication. Polymeric films can embody blooming compounds which provide lubricant during fabricating steps.

The thickness of the shingle structure sheet metal depends, in part, on the type of roof and the mechanical properties to be selected. Practical flat-rolled sheet metal thickness gages are:

| Sheet Metal | Thickness |
|---|---|
| low-carbon steel | .014–.03 inches |
| aluminum alloys | .02–.035 inches |
| copper | .025–.035 inches |
| hot-dip galvanized steel | .015–.03 inches |
| electro-plated steel | .015–.03 inches |
| terne-coated steel | .017–.032 inches |
| stainless steel | .01–.025 inches |

Other gages of sheet metal can be selected dependent on roofing application requirements and sheet metal temper hardness and the like. Increased sheet metal thickness is utilized to increase impact-resistance for such metals as copper or aluminum alloys. Increased thickness increases substrate weight regardless of the sheet metal selected. However, for residential housing, the flat-rolled steel shingle structures of the invention weigh less per square (10'×10'= 100 $ft^2$) than any of the slate, ceramic or cement/grout roofing materials in use; and, also, weigh less than the composites of asphalt-tar and felt layers with pulverant stone coating in wide use at the time of this invention.

Figure 17:
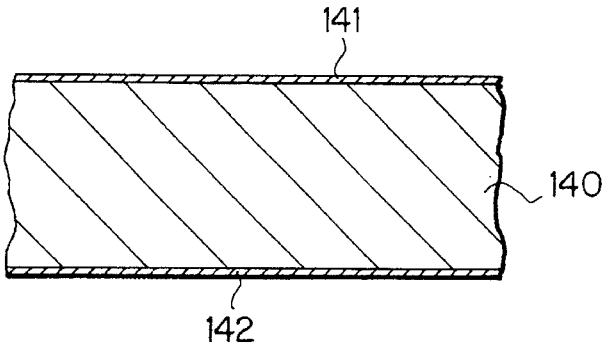
FIGS. 17–20 are enlarged cross-sectional views of a portion of a unitary sheet metal blank shown for describing flat-rolled sheet metal embodiments with various combinations of sheet metal, treatments and surface coatings of the invention.

Surface treatment and coatings for sheet metal substrate are described in relation to FIGS. 17–20. Referring to FIG. 17, a sheet metal substrate 140, such as the preferred flat-rolled steel embodiment, can be chemically treated on both planar surfaces to inhibit oxidation during handling and/or can be chemically treated for surfactant purposes for subsequent finish paint or polymeric coating. Such chemical treatment coating surfaces are designated 141, 142. Chemical treatment for subsequent coating by painting can employ conversion coatings comprising a phosphate or a mixed metal oxide utilizing oxides of chromium, cobalt, iron, or nickel, alone or in combination. Zinc phosphate is an effective conversion coating. Such a chemical treatment satisfactorily inhibits oxidation and improves paint adhesion for zinc or zinc-aluminum galvanizing alloy-coated steel or other metal coatings for flat-rolled mild steel.

Figure 18:
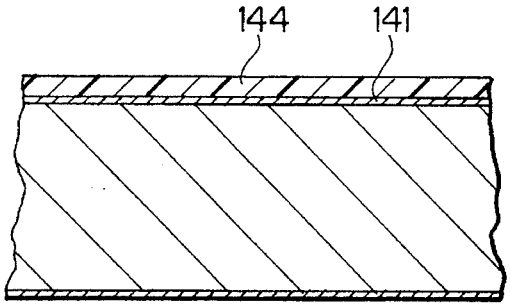

In FIG. 18, a polymeric coating 144 is added to at least one surface, such as surface 141, for surface protection and/or pigmentation. A thermosetting polymeric coating is selected preferably from the group consisting of polyvinylidene fluoride, acrylic, polyester and vinyl plastisol. Polyvinylidene fluoride, acrylic, and polyester can be applied as a primer with a thickness of about 0.03" followed by a polymeric finish coating having a thickness of about 0.08". Vinyl plastisol can generally be applied in a thickness range of 0.004" to 0.01".

Figure 19:
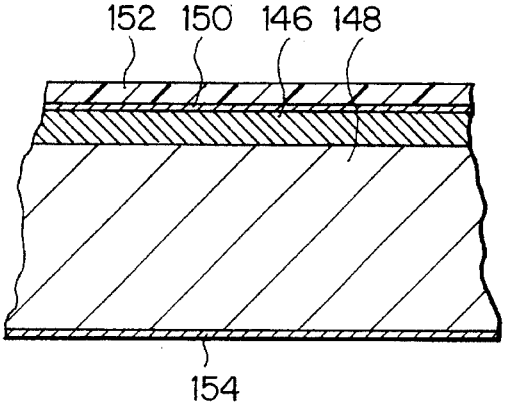

In another embodiment of the present invention shown in FIG. 19, a metal coating 146, such as a hot-dip galvanizing metal coating, is applied to at least one planar surface of flat-rolled steel substrate 148; such galvanized-coated surface is selected to provide the exterior shingle structure surface. Added corrosion protection and long life surface protection is thus provided by taking advantage of the sacrificial properties of zinc on steel due to the relative electrochemical activities of zinc and iron. The total galvanizing metal coating weight is generally selected in the range of about 0.5 to about 1.25 oz/$ft^2$. A chemical treatment coating 150 is added to galvanized surface 146 to enhance application of finish coatings such as paint. A polymeric finish coating 152 adds to the long range surface protection and increases finish color selection. The interior surface of sheet metal substrate 148 is coated with a chemical treatment 154 for corrosion-protection purposes.

Figure 20:
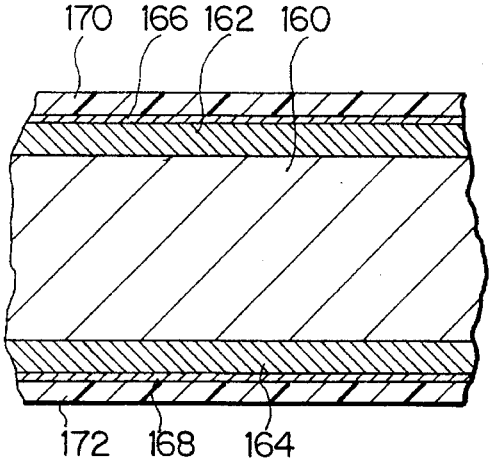

A preferred embodiment is shown in FIG. 20 for sheet metals such as flat-rolled mild steel. Sheet metal 160 is coated on both planar surfaces with a protective metal coating, such as a galvanizing metal coating 162, 164. A chemical treatment coating 166, 168 is added to each surface to facilitate reception and adhesion of a thermosetting polymeric finish coating 170, 172, respectively, on each surface. Such polymeric coatings facilitate fabrication by embodying a blooming-compound lubricant released during the pressure and/or heating generated by the forming operations.

Figure 21:
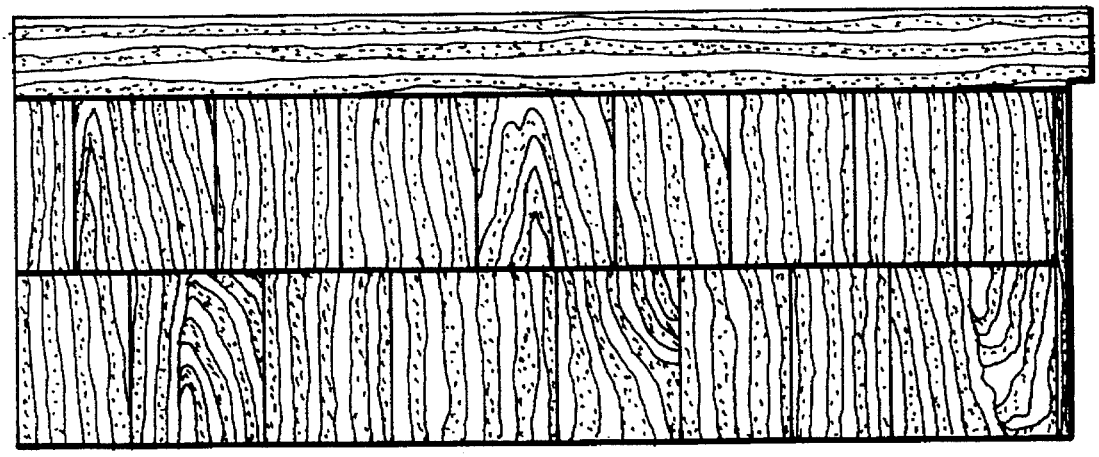
FIG. 21 is a top plan view for describing a specific finishing pattern of the invention.

Pigmented polymeric finish coatings can simulate cedar shake, asphalt stone colorings, slate coloring, or woodgrain pattern, such as the wood shake pattern of FIG. 21, without interfering with the interlocking capabilities as described in relation to FIGS. 3–9.

Sheet metal extends the life of shingle structures by providing roofing protection against moisture and being substantially impervious to moisture. The unitary sheet metal shingle structures of the invention are fireproof and, as assembled, produce a tight, interlocking fit on each side of a rectangular configuration exposed portion. Resulting contributions are better insulation and weatherproofing, as well as better protection against wind driven rain and wind damage. In addition, the sheet metal shingle structure configurations of the invention provide for incrementally-distributing expansion and contraction over roofing expanses.

While specific materials, dimensional data, processing and fabricating steps have been set forth for purposes of describing embodiments of the invention, various modifications can be resorted to, in light of the above teachings, without departing from applicants' novel contributions; therefore in determining the scope of the present invention, reference shall be made to the appended claims.

What is claimed is:

1. Preparation of sheet metal and fabrication of roofing shingle structures, comprising the steps of:

(A) processing flat-rolled sheet metal to preselected thickness gage, mechanical properties and surface characteristics;

(B) cutting the flat-rolled sheet metal into generally-rectangular-configuration unitary blanks, each for fabricating into a unitary roofing shingle structure, such a unitary structure having:

a horizontally-directed axis extending in a direction which is substantially coincident with assembling shingle structures in side-by-side interfitting relationship in a substantially-horizontal direction to provide roof covering, and a vertically-directed axis in substantially right-angled relationship to such horizontally-directed axis and extending in a direction in which shingle structures are assembled in overlapping relationship to provide a roof covering;

(C) designating portions of the unitary blank to be cut away from and portions to be folded over in relation to remaining portions of the unitary blank for fabrication of a shingle structure having an exterior and an interior surface, such exterior surface presenting:

an upper cover portion which, during roofing assembly of shingle structures in overlapping relationship in such vertical direction, is covered by next vertically-adjacent course shingle structure means in an upward direction, and a lower course portion which remains exposed during roofing assembly of shingle structures in such vertical direction overlapping relationship and in such horizontal direction interfitting side-by-side relationship;

(D) cutting away portions of such unitary blank to assist in providing for folding over sheet metal layers of the shingle structure being fabricated;

(E) folding over a vertically-extending sheet metal layer on each lateral side of the shingle structure along at least such lower course portion, with one such lateral edge layer being folded over onto the exterior surface of the shingle structure being fabricated, and the remaining lateral edge layer being folded over onto the interior surface of such shingle structure, with each such lateral edge sheet metal layer being folded over along such lower course portion so as to enable receiving a folded over lateral edge sheet metal layer located on an opposite surface of a contiguous shingle structure to provide a weatherproofing interlock along each lateral side of an exposed course portion as part of side-by-side assembly of shingle structures in such generally horizontal direction for roof covering;

(F) folding over sheet metal layers extending in such horizontal direction, including:

folding over a lower edge sheet metal layer so as to form a horizontally-extending upwardly-opening slot for receiving a portion of a vertically-adjacent shingle structure, and folding over multiple sheet metal layers along a centrally-located horizontally-extending portion of the shingle structure to extend between its lateral sides and be positioned contiguous to a location separating the upper cover portion from the lower exposed course portion of the shingle structure, with such centrally-located horizontally-extending folded-over multiple sheet metal layers defining horizontally-extending centrally-located slot means for distal end intercoupling with folded-over multiple sheet metal layers defining a horizontally-extending centrally-located slot means of an adjacent side-by-side shingle structure being assembled in such horizontal direction.

2. The method of claim 1, in which such horizontally-extending lower-edge slot opens onto such interior surface of the shingle structure and is formed by a sheet metal layer being oriented in a vertically-upward direction toward the cover portion of the shingle structure.

3. The method of claim 2, in which such horizontally-extending centrally-located slot means includes a slot formed to open onto such exterior surface of the shingle structure in a vertically-downward direction, and a slot formed to open onto such interior surface of the shingle structure in a vertically-upward direction.

4. The method of claim 3, in which such horizontally-extending centrally-located slot means are formed with a differing slot opening dimensions between lateral sides of the shingle structure for establishing an intercoupling nesting relationship with a next adjacent shingle structure during assembly in such horizontal direction.

5. The method of claim 3, in which sheet metal of one lateral edge is folded over to be part of the centrally-located horizontally-directed slot which opens onto such exterior surface of the shingle structure, and sheet metal of the remaining lateral edge is folded over to be part of such horizontally-directed slot which opens onto the interior surface of such shingle structure.

6. The method of claim 1, in which the flat-rolled sheet metal is processed in continuous-strip form to provide desired mechanical properties in such sheet metal by selecting from the group consisting of:

cold-reduction of such sheet metal to work harden such sheet metal, heat-treatment of such sheet metal to at least partially relieve cold-working stress in such sheet metal, and combinations thereof; and, in which surface treatment of the flat-rolled sheet metal is selected from the group consisting of a chemical treatment, a protective metal coating, a surface finish coating, and combinations thereof.

7. The method of claim 6, including the steps of selecting flat-rolled low-carbon steel substrate having a nominal thickness gage of about 0.015" to about 0.03";

preparing such steel substrate for protective metal coating, and applying a protective metal coating, selected from the group consisting of electrolytic galvanized coating, hot-dip galvanized coating, copper plating, terne metal coating, and tin-mill electrolytically-applied plating, to at least one surface of such continuous strip before cutting such unitary blanks for fabricating unitary shingle structures, with at least one protective metal coated surface comprising such exterior for unitary shingle structures to be fabricated from such sheet metal.

8. The method of claim 7, in which a hot-dip galvanized coating is selected and is applied to each surface of such continuous-strip sheet metal substrate to have a coating weight selected in the range of about 0.5 oz/ft$^2$ to about 1.25 oz/ft$^2$.

9. The method of claim 8, further including the steps of:

applying a chemical surface treatment to at least such hot-dip galvanized-coated surface for the exterior of a shingle structure to be formed from such coated sheet metal, to prepare such galvanized surface for a finish coating, and, then applying finish coating selected from the group consisting of galvanized coating paint and a thermosetting polymeric film to such chemically treated surface.

10. The method of claim 9, including selecting a thermosetting polymeric film finish coating selected from the group consisting of polyvinylidene fluoride, acrylic, polyester and vinyl plastisol.

11. The method of claim 1, further including the step of:

embossing a preselected surface texture into at least that portion of such unitary blank which will comprise the exposed portion of a shingle structure after assembly into a roof covering.

12. The method of claim 11, in which such unitary blank is cut from the flat-rolled sheet metal and fabricated so as to provide the appearance of more than a single shingle tab in such exposed portion of the shingle structure formed from such unitary blank.

13. The method of claim 1, further including the step of:

forming at least a pair of apertures in the cover portion of each such shingle structure as fabricated, one each of such apertures being located contiguous to a lateral side of the shingle structure for receiving a roofing shingle fastener, and in which each such lateral side aperture is located so as to coincide with a lateral side aperture of a next adjacent shingle structure in such horizontal-direction side-by-side assembly so as to enable use of a single fastener at such coincident location of apertures for fastening such two adjacent shingle structures to subsurface roofing support means.

14. The method of claim 1, in which such apertures facilitate horizontal-direction and vertical-direction alignment of shingle structures, as well as allow for minor horizontal and vertical adjustment of relative locations of shingle structures during assembly of roof covering.

* * * * *